US010722097B2

(12) United States Patent
Mills et al.

(10) Patent No.: US 10,722,097 B2
(45) Date of Patent: Jul. 28, 2020

(54) WAREWASHER WITH HEAT RECOVERY SYSTEM

(71) Applicant: ILLINOIS TOOL WORKS INC., Glenview, IL (US)

(72) Inventors: Nigel G. Mills, Kettering, OH (US); Alexander R. Anim-Mensah, Miamisburg, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 16/238,650

(22) Filed: Jan. 3, 2019

(65) Prior Publication Data

US 2019/0133405 A1 May 9, 2019

Related U.S. Application Data

(63) Continuation of application No. 15/177,965, filed on Jun. 9, 2016, now Pat. No. 10,178,937.
(Continued)

(51) Int. Cl.
*A47L 15/00* (2006.01)
*A47L 15/24* (2006.01)
(Continued)

(52) U.S. Cl.
CPC ..... *A47L 15/0078* (2013.01); *A47L 15/0015* (2013.01); *A47L 15/0047* (2013.01);
(Continued)

(58) Field of Classification Search
CPC ..... A47L 15/0015; A47L 15/0047; A47L 15/0078; A47L 15/241; A47L 15/4214;
(Continued)

(56) References Cited

U.S. PATENT DOCUMENTS 3,315,293 A 4/1967 Warner et al.
3,598,131 A 8/1971 Weihe, Jr.
(Continued)

FOREIGN PATENT DOCUMENTS

CN 1272915 A 11/2000
CN 2798838 Y 7/2006
(Continued)

OTHER PUBLICATIONS

Tsukada et al., "JP2008267616A English Machine Translation.pdf", Nov. 6, 2008—Machine translation from Espacenet.com.*
(Continued)

*Primary Examiner* — Levon J Shahinian
(74) *Attorney, Agent, or Firm* — Thompson Hine LLP

(57) ABSTRACT

A warewash machine includes a chamber for receiving wares, the chamber having at least one wash zone. A refrigerant medium circuit includes a first condenser and a second condenser, the first condenser located upstream of the second condenser in the refrigerant circuit. The refrigerant medium circuit includes a first flow path through the first condenser and a second flow path in bypass of the first condenser, and a valve for selectively controlling whether at least some refrigerant medium flows along the first flow path or the second flow path.

20 Claims, 2 Drawing Sheets

Related U.S. Application Data

(60) Provisional application No. 62/199,519, filed on Jul. 31, 2015.

(51) Int. Cl.

| | |
|---|---|
| ***A47L 15/42*** | (2006.01) |
| ***A47L 15/48*** | (2006.01) |
| ***F25B 39/00*** | (2006.01) |
| ***F25B 39/04*** | (2006.01) |

(52) U.S. Cl.
CPC ..... *A47L 15/241* (2013.01); *A47L 15/4225* (2013.01); *A47L 15/4291* (2013.01); *F25B 39/00* (2013.01); *A47L 15/4214* (2013.01); *A47L 15/4285* (2013.01); *A47L 15/483* (2013.01); *A47L 2401/34* (2013.01); *F25B 39/04* (2013.01)

(58) Field of Classification Search
CPC ..... A47L 15/4225; A47L 15/4285; A47L 15/4291; A47L 15/483; A47L 2401/34; F25B 39/00; F25B 39/04
USPC ..... 134/56 D, 57 D, 58 D, 105, 107, 108
See application file for complete search history.

(56) References Cited

U.S. PATENT DOCUMENTS

| | | | | |
|---|---|---|---|---|
| 3,789,860 | A | 2/1974 | Katterheinrich et al. | |
| 3,946,802 | A | 3/1976 | Christenson | |
| 3,965,494 | A | 6/1976 | Baker | |
| 3,986,345 | A | 10/1976 | Pilz et al. | |
| 4,098,616 | A | 7/1978 | Dorius et al. | |
| 4,125,148 | A | 11/1978 | Molitor | |
| 4,129,179 | A | 12/1978 | Molitor | |
| 4,219,044 | A | 8/1980 | Wilson | |
| 4,326,551 | A | 4/1982 | Voorhees | |
| 4,519,440 | A | 5/1985 | Weitman | |
| 4,529,032 | A | 7/1985 | Molitor | |
| 4,531,572 | A | 7/1985 | Molitor | |
| 5,331,984 | A | 7/1994 | Isagawa | |
| 5,642,742 | A | 7/1997 | Noren et al. | |
| 5,660,193 | A | 8/1997 | Archer et al. | |
| 5,794,634 | A | 8/1998 | Noren et al. | |
| 5,816,273 | A | 10/1998 | Milocco et al. | |
| 5,829,459 | A | 11/1998 | Milocco et al. | |
| 5,884,694 | A | 3/1999 | Tanenbaum | |
| 5,934,078 | A | 8/1999 | Lawton, Jr. et al. | |
| 6,072,153 | A | 6/2000 | Aoki et al. | |
| 6,357,245 | B1 | 3/2002 | Weng et al. | |
| 6,591,846 | B1 | 7/2003 | Ferguson et al. | |
| 7,103,992 | B2 | 9/2006 | Deden et al. | |
| RE40,123 | E | 3/2008 | Johansen et al. | |
| 8,157,924 | B2 | 4/2012 | Warner et al. | |
| 8,498,523 | B2 | 7/2013 | Deivasigamani et al. | |
| 8,663,395 | B2 | 3/2014 | Warner et al. | |
| 8,679,261 | B2 | 3/2014 | Brunswick et al. | |
| 10,178,937 | B2 * | 1/2019 | Mills | F25B 39/00 |
| 2003/0005731 | A1 | 1/2003 | Montgomery | |
| 2003/0178498 | A1 | 9/2003 | Saitoh et al. | |
| 2004/0123880 | A1 | 7/2004 | Chiles et al. | |
| 2004/0187339 | A1 | 9/2004 | Duden et al. | |
| 2004/0200905 | A1 | 10/2004 | Saitoh et al. | |
| 2004/0227003 | A1 | 11/2004 | Alvarez et al. | |
| 2004/0261820 | A1 | 12/2004 | Monsrud et al. | |
| 2005/0167516 | A1 | 8/2005 | Saitoh et al. | |
| 2006/0073430 | A1 | 4/2006 | Chiles et al. | |
| 2006/0090798 | A1 | 5/2006 | Beagen et al. | |
| 2007/0089230 | A1 | 4/2007 | Hendricks | |
| 2007/0143914 | A1 | 6/2007 | Shirai et al. | |
| 2007/0170270 | A1 | 7/2007 | Jelinek et al. | |
| 2007/0210118 | A1 | 9/2007 | Gadini | |
| 2008/0000616 | A1 | 1/2008 | Nobile | |
| 2008/0077281 | A1 | 3/2008 | Gaus | |
| 2008/0087307 | A1 | 4/2008 | Han | |
| 2008/0115807 | A1 | 5/2008 | Gaus | |
| 2009/0025557 | A1 | 1/2009 | Moschuetz | |
| 2009/0120465 | A1 | 5/2009 | Peukert et al. | |
| 2009/0151750 | A1 | 6/2009 | Ecker et al. | |
| 2009/0277482 | A1 | 11/2009 | Kim et al. | |
| 2010/0024844 | A1 | 2/2010 | Brunswick et al. | |
| 2011/0048342 | A1 | 3/2011 | Vroom | |
| 2014/0007767 | A1 * | 1/2014 | Grunewald | A47L 15/481 95/126 |

FOREIGN PATENT DOCUMENTS

| | | | |
|---|---|---|---|
| CN | 203252618 | U | 10/2013 |
| CN | 103519764 | A | 1/2014 |
| CN | 203408012 | U | 1/2014 |
| CN | 203914825 | U | 11/2014 |
| CN | 204218845 | U | 3/2015 |
| CN | 204313358 | U | 5/2015 |
| CN | 104748433 | A | 7/2015 |
| CN | 108135430 | A | 6/2018 |
| EP | 0862889 | A2 | 9/1998 |
| EP | 1913860 | B1 | 4/2008 |
| EP | 2449945 | A2 | 5/2012 |
| EP | 2746454 | | 6/2014 |
| JP | 2008267616 | A * | 11/2008 |
| JP | 2008279026 | A | 11/2008 |
| WO | WO 2015/080928 | | 6/2015 |

OTHER PUBLICATIONS

PCT, International Search Report and Written Opinion, International Application No. PCT/US2016/043069; dated Sep. 29, 2016, 12 pages.

Xu Ming, "*A Design of a Fan Drying Device for Dishwasher*", Electrical Appliances, Issue No. 12, Dec. 25, 2012, Full text, 2 pages.

* cited by examiner

WAREWASHER WITH HEAT RECOVERY SYSTEM

TECHNICAL FIELD

This application relates generally to warewashers such as those used in commercial applications such as cafeterias and restaurants and, more particularly, to a heat recovery system that adapts to operating conditions of the warewasher.

BACKGROUND

Commercial warewashers commonly include a housing area which defines washing and rinsing zones for dishes, pots, pans and other wares. Heat recovery systems have been used to recover heat from the machine that would ordinarily be lost to the machine exhaust.

Waste heat recovery systems such as a heat pump or refrigeration system uses evaporator(s), compressor(s) and condenser(s) such that the operation involves thermal fluids (including refrigerant) for recovering waste energy and re-using captured energy at areas of interest. The systems require the thermal fluid to operate within a specified envelope to prevent system shut down from high or low pressure, hence, the need for effective controls.

It would be desirable to provide a heat recovery system that adapts to machine operating conditions in order to make more effective use of heat recovery. It would also be desirable to support such heat recovery systems to enable operation continuously or semi-continuously at startup, at steady state or at the standby or idle mode while simultaneously recovering waste energy and tempering the exhaust gas hot stream to an acceptable temperature by the use of thermal fluid(s).

SUMMARY

In one aspect, a warewash machine includes a chamber for receiving wares, the chamber having at least one wash zone. A refrigerant medium circuit includes a first condenser and a second condenser, the first condenser located upstream of the second condenser in the refrigerant medium circuit. The refrigerant medium circuit includes a first flow path through the first condenser and a second flow path in bypass of the first condenser, and a valve for selectively controlling whether at least some refrigerant medium flows along the first flow path or the second flow path based upon heat demand on the second condenser.

In one implementation, the bypass arrangement includes a valve upstream of the first condenser, and a bypass path from the valve to a downstream side of the first condenser. The bypass arrangement can further include a temperature sensor associated with the second condenser and operatively connected to effect control of the valve. A controller may connected with the temperature sensor and responsively controls the valve based upon the temperature condition. The controller may be configured to switch the valve to flow at least some refrigerant medium along the bypass path when the temperature sensor indicates a low temperature condition indicative of high heat demand on the second condenser.

In one implementation, the first fluid is incoming water, the first condenser is arranged to deliver refrigerant medium heat to the incoming water and the incoming water is then delivered to a booster heater of the machine, and the second fluid is wash liquid within a wash tank of the machine, and the second condenser arranged to deliver refrigerant medium heat to the wash liquid.

The temperature sensor may detect a temperature of the wash liquid within the wash tank.

In one example, a third condenser is located downstream of the second condenser and is arranged for delivering refrigerant medium heat to drying air of the machine, and a fourth condenser is located downstream of the third condenser and is arranged to deliver refrigerant medium heat to the incoming water before the incoming water reaches the first condenser.

In one example, a first waste heat recovery unit is arranged to transfer heat from exhaust air of the machine to incoming water before the incoming water reaches the first condenser, and a second waste heat recovery unit is arranged to transfer heat from exhaust air of the machine to refrigerant medium in the refrigerant medium circuit, the second waste heat recovery unit located along the refrigerant medium path downstream of the second condenser and upstream of a compressor.

In another aspect, a warewash machine includes a chamber for receiving wares, the chamber having at least one wash zone. A refrigerant medium circuit includes a first heat exchanger and a second heat exchanger, the first heat exchanger located upstream of the second condenser in the refrigerant medium circuit. The refrigerant medium circuit includes a primary flow path through the first heat exchanger and a secondary flow path in bypass of the first heat exchanger, and a valve for selectively controlling whether at least some refrigerant medium flows along the primary flow path or the secondary flow path.

In a further aspect, a method is provided for controlling refrigerant flow in a refrigerant circuit of a warewash machine that includes a chamber for receiving wares, the chamber having at least one wash zone, the refrigerant circuit including a first condenser and a second condenser, the first condenser located upstream of the second condenser in the refrigerant circuit. The method involves: flowing refrigerant through both the first condenser and the second condenser; and selectively bypassing at least some refrigerant flow around the first condenser based upon a monitored heat demand of the second condenser In another aspect, a method is provided for controlling refrigerant flow in a refrigerant circuit of a warewash machine that includes a chamber for receiving wares, the chamber having at least one wash zone, the refrigerant circuit including a first condenser and a second condenser, the first condenser located upstream of the second condenser in the refrigerant circuit. The method involves: flowing refrigerant through both the first condenser and the second condenser; and identifying a low temperature condition of an environment of the second condenser and thereafter causing at least some refrigerant to flow in bypass around the first condenser and to the second condenser.

The details of one or more embodiments are set forth in the accompanying drawings and the description below. Other features, objects, and advantages will be apparent from the description and drawings, and from the claims.

DETAILED DESCRIPTION

Figure 1:
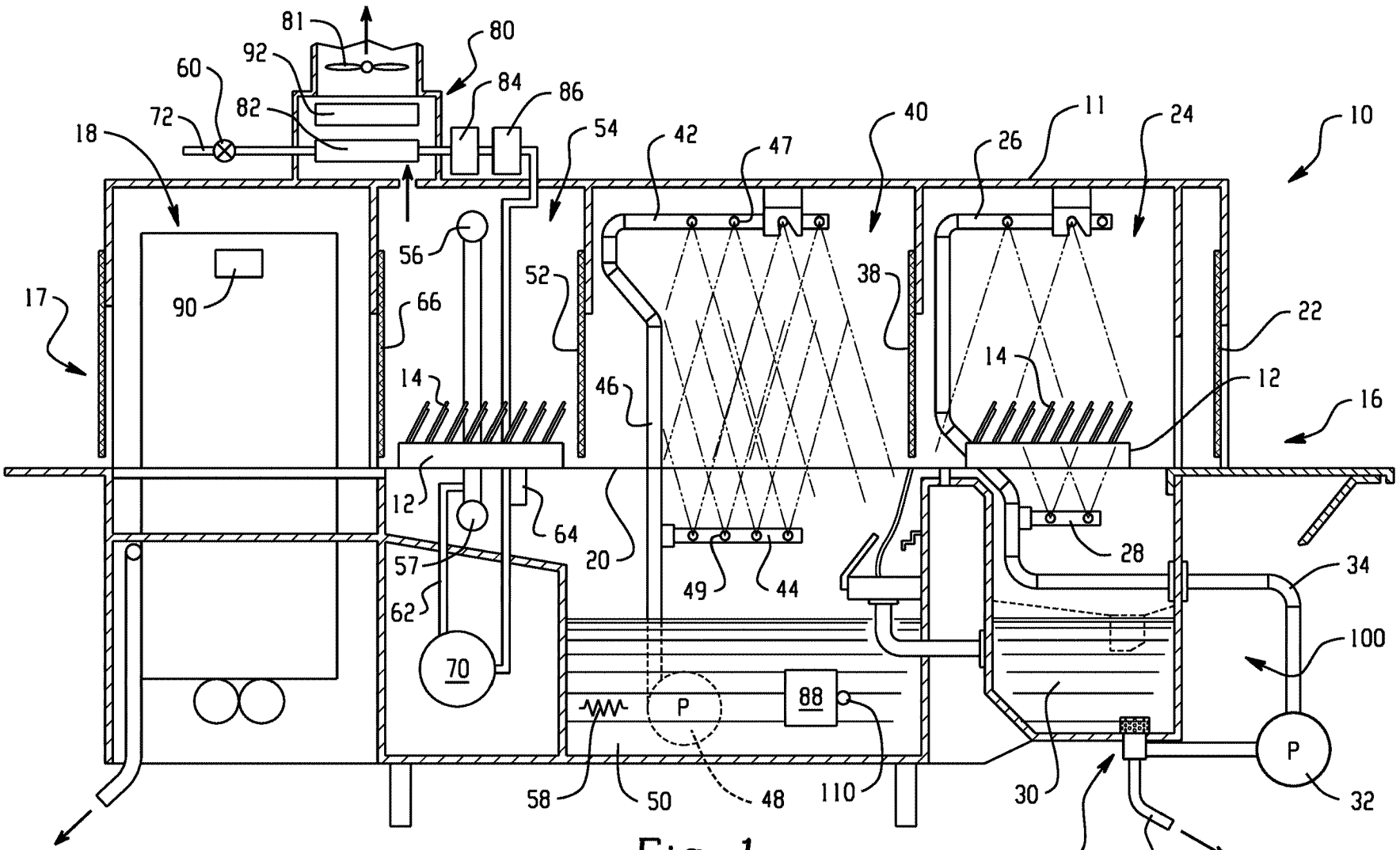
FIG. 1 is a schematic side elevation of one embodiment of a warewasher.

Referring to FIG. 1, an exemplary conveyor-type warewash machine, generally designated 10, is shown. Warewash machine 10 includes a housing 11 that can receive racks 12 of soiled wares 14 from an input side 16. The wares are moved through tunnel-like chambers from the input side toward a blower dryer unit 18 at an opposite exit end 17 of the warewash system by a suitable conveyor mechanism 20. Either continuously or intermittently moving conveyor mechanisms or combinations thereof may be used, depending, for example, on the style, model and size of the warewash system 10. Flight-type conveyors in which racks are not used are also possible. In the illustrated example, the racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 and is delivered to the manifolds via a pump 32 and supply conduit 34. A drain structure 36 provides a single location where liquid is pumped from the tank 30 using the pump 32. Via the same drain structure, liquid can also be drained from the tank and out of the machine via drain path 37, for example, for a tank cleaning operation.

The racks proceed to a next curtain 38 into a main wash chamber or zone 40, where the wares are subject to sprays of cleansing wash liquid (e.g., typically water with detergent) from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse (also known as post-wash) chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 57 that are supplied with a flow of fresh hot water via pipe 62 running from a hot water booster 70 under the control of a solenoid valve 60 (or alternatively any other suitable valve capable of automatic control). A rack detector 64 may be actuated when a rack 12 of wares 14 is positioned in the final rinse chamber 54 and through suitable electrical controls (e.g., the controller mentioned below), the detector causes actuation of the solenoid valve 60 to open and admit the hot rinse water to the spray heads 56, 57. The water then drains from the wares and is directed into the tank 50 by gravity flow. The rinsed rack 12 of wares 14 then exits the final rinse chamber 54 through curtain 66, moving into dryer unit 18, before exiting the outlet end 17 of the machine.

An exhaust system 80 for pulling hot moist air from the machine (e.g., via operation of a blower 81) may be provided. As shown, a cold water input 72 line may run through a waste heat recovery unit 82 (e.g., a fin-and-tube heat exchanger through which the incoming water flows, though other variations are possible) to recover heat from the exhaust air flowing across and/or through the unit 82. The water line or flow path 72 then runs through one or more condensers 84 and 86 (e.g., in the form of plate heat exchangers or shell-and-tube heat exchangers, though other variations are possible), before delivering the water to the booster 70 for final heating. A condenser 88 may be located in the wash tank and a condenser 90 may be located in the blower dryer unit 18. A second waste heat recovery unit 92 may also be provided.

Figure 2:
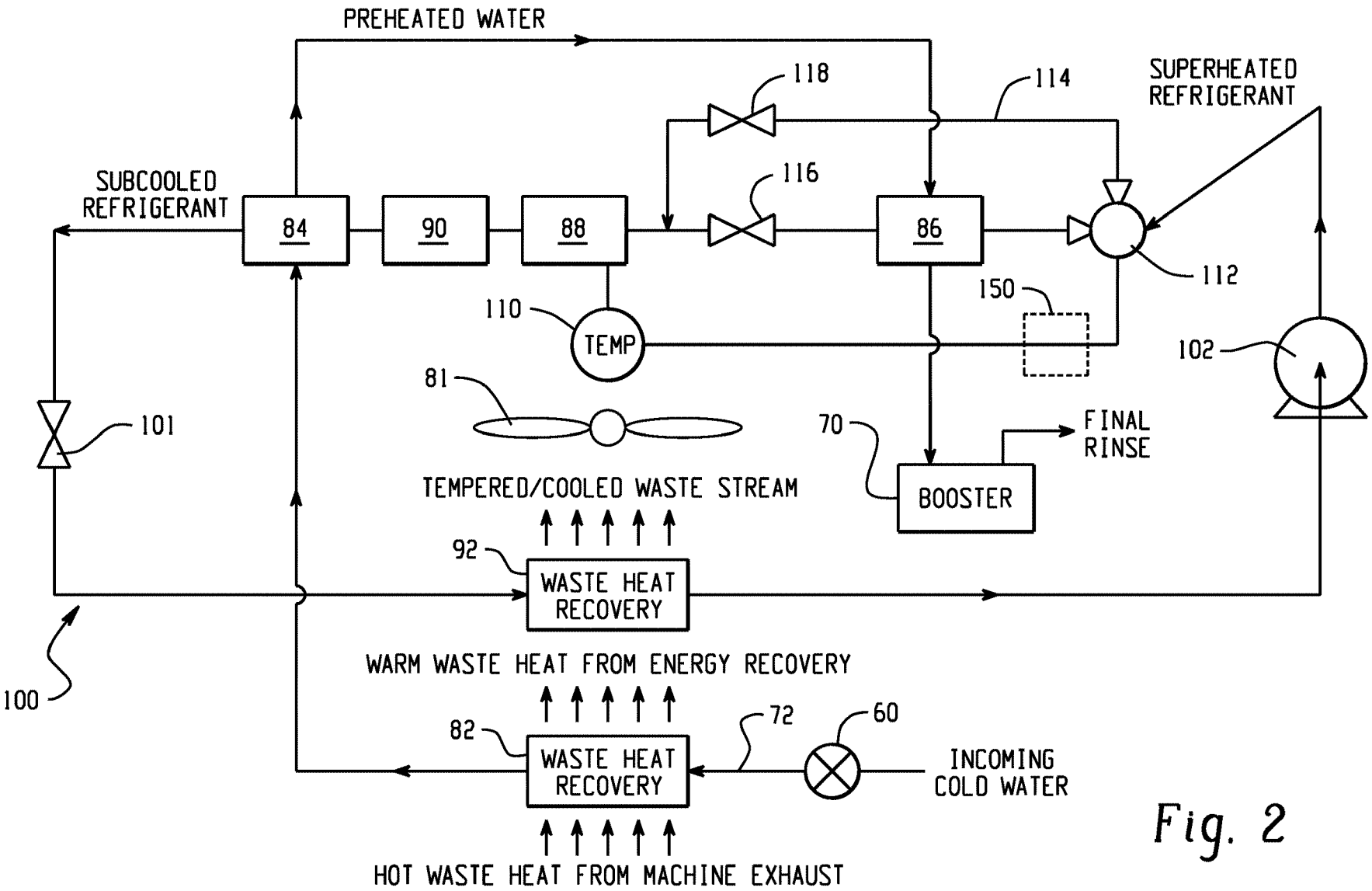
FIG. 2 is a schematic depiction of a refrigerant medium circuit and an incoming water flow path of the warewash machine.

Referring now to FIG. 2, the flow configuration for both incoming fresh cold water and for refrigerant are shown. Cold fresh water is first heated by the hot air passing through the waste heat recovery unit 82, then heated further by refrigerant when passing through condenser 84 and finally heated further by superheated refrigerant when passing through condenser 86. The heated water then enters the booster 70 for final heating. The refrigerant medium circuit 100 includes a thermal expansion valve 101, which leads to a waste heat recovery unit 92 to recover heat from warm waste air (e.g., the exhaust air flow) after some heat has already been removed from the exhaust air flow by unit 82. A compressor 102 compresses the refrigerant to produce superheated refrigerant, which then flows sequentially through the condensers 86, 88, 90 and 84.

Generally, condenser 86 delivers refrigerant heat to the incoming fresh water, condenser 88 may take the form of coil submerged in the wash tank 50 to deliver refrigerant heat to the wash water, condenser 90 may take the form of a coil over which the drying air blows to deliver some refrigerant heat to the drying air and condenser 84, which may be a plate-type heat exchanger, delivers residual refrigerant heat to the incoming fresh water. However, this flow may be altered based upon warewash machine conditions.

In this regard, a temperature sensor 110 is provided to monitor the temperature of the wash tank condenser 88. The temperature sensor may be in direct contact with the condenser 88 or may simply monitor the surrounding wash tank liquid temperature, which in either case represents a temperature condition of the water in the tank and is therefore indicative of heat demand on the condenser 88. If the monitored temperature falls below a specified threshold temperature, a two way valve 112 is controlled to cause superheated refrigerant to bypass condenser 86 along bypass path 114 so as to flow directly to condenser 88, causing more heat to be transferred from the refrigerant to the wash tank wash liquid. This operation assures that more refrigerant heat is transferred to the wash tank wash liquid when needed, so as to more effectively augment the heating performed by heater 58 (FIG. 1), and thus more quickly bring the wash tank wash liquid up to desired or required temperature. Check valves 116 and 118 are provided respectively on the primary refrigerant path and the bypass path 114. When the heat demand on the condenser 88 is no longer deemed high (e.g., when the temperature sensor 110 indication rises above the specified threshold temperature or a temperature slightly higher than the specified temperature threshold), the valve 112 can be switched back to again provide refrigerant flow through the condenser 86.

In one example valve 112 is configured to switch an entirety of the refrigerant medium flow between the path through condenser 86 and the bypass path. However, valve 112 could alternatively be a proportional valve that is capable of partially splitting the flow between the two paths in variable amounts (e.g., 80/20, 50/50, 20/80 or any desired split). This latter arrangement could provide for more precisely responding to heat demand on condenser 88.

A controller 150 may be provided to effect switching of the valve 112 (or varied control of the valve) based upon temperature output of sensor 110, as well as for controlling other functions and operations of the machine. As used herein, the term controller is intended to broadly encompass any circuit (e.g., solid state, application specific integrated circuit (ASIC), an electronic circuit, a combinational logic circuit, a field programmable gate array (FPGA)), processor (e.g., shared, dedicated, or group—including hardware or software that executes code) or other component, or a combination of some or all of the above, that carries out the control functions of the machine or the control functions of any component thereof.

Thus, the system provides an advantageous method of refrigerant flow in a warewash machine that includes a chamber for receiving wares, where the chamber has at least one wash zone, and the refrigerant circuit includes a first condenser and a second condenser, the first condenser located upstream of the second condenser in the refrigerant circuit. The method involves: flowing refrigerant through both the first condenser and the second condenser; and selectively bypassing refrigerant flow around the first condenser based upon a monitored heat demand of the second condenser. Heat demand of the second condenser may be monitored by sensing a temperature condition of an environment of the second condenser. The monitoring may be continuous, periodic or triggered by some event (e.g., identification of a rack at a certain location in the machine). Refrigerant flow may be selectively bypassed around the first condenser in response to identification of a low temperature condition of the environment of the second condenser. The low temperature condition may be identified when a temperature sensor indicates a temperature below a set threshold temperature. In some machines, the set threshold temperature can be varied (e.g., via an operator interface associated with the controller 150 or via a restricted service/maintenance personnel interface).

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application. For example, the term refrigerant commonly refers to known acceptable refrigerants, but other thermal fluids could be used in refrigerant type circuits. The term "refrigerant medium" is intended to encompass all such traditional refrigerants and other thermal fluids. Moreover, while bypass of a first condenser in a four condenser system is primarily described, it is recognized that a lesser number of condensers could be used in some implementations and/or that one or more other or additional condensers could include a similar heat demand triggered bypass (e.g., selective bypass of condenser 88 based upon a heat demand of condenser 90). It is also recognized that bypass of an upstream condenser could be triggered by heat demand of any one of the downstream condensers (e.g., selective bypass of condenser 86 based upon heat demand of condenser 90). In addition, other refrigerant circuit conditions could be monitored in order to trigger selective bypass of a condenser.

What is claimed is:

1. A warewash machine for washing wares, comprising:

a chamber for receiving wares, the chamber having at least one wash zone;

a refrigerant medium circuit including a compressor, a first condenser and a second condenser, and an expansion device, wherein the first condenser and the second condenser are located downstream of the compressor and upstream of the expansion device in the refrigerant medium circuit, wherein the first condenser is located upstream of the second condenser in the refrigerant medium circuit, the refrigerant medium circuit including a first flow path through both the first condenser and the second condenser, a second flow path in bypass of the first condenser and through the second condenser, and a valve positioned along the refrigerant medium circuit between the compressor and the first condenser for selectively controlling whether at least some refrigerant medium flows along the first flow path or the second flow path.

2. The machine of claim 1 wherein the valve is selectively controlled based upon monitored heat demand on the second condenser.

3. The machine of claim 2 wherein the first condenser is arranged to deliver refrigerant medium heat to water being delivered to a booster heater of the machine, and the second condenser is arranged to deliver refrigerant medium heat to wash liquid in a wash tank of the machine.

4. The machine of claim 3 wherein a temperature sensor detects a temperature of a wash liquid within the wash tank in order to monitor heat demand on the second condenser.

5. The machine of claim 4 wherein a controller is connected with the temperature sensor and responsively controls the valve to flow at least some refrigerant medium along the second flow path when a temperature indicated by the temperature sensor falls below a set threshold.

6. The machine of claim 1 wherein the valve is a proportional valve that is controllable to achieve simultaneous flow of some refrigerant medium along the first flow path and some refrigerant medium along the second flow path.

7. The machine of claim 1 wherein a controller is configured to identify occurrence of a predefined condition of the refrigeration medium circuit downstream of the first condenser, and the controller is configured such that upon identification of the predefined condition the controller operates the valve to cause flow along the second flow path.

8. The machine of claim 7 wherein the predefined condition is a high heat demand of the second condenser.

9. The machine of claim 1 wherein the refrigerant medium circuit also includes a third condenser downstream of the second condenser, the third condenser configured to deliver heat from exhaust air of the washing machine to the refrigerant medium, wherein both the first flow path and the second flow path are fluidly connected to deliver refrigerant medium to the third condenser.

10. A warewash machine for washing wares, comprising:

a chamber for receiving wares, the chamber having at least one wash zone;

a refrigerant medium circuit including a compressor, an expansion device, a first condenser arranged to deliver refrigerant medium heat to a first fluid and a second condenser arranged to deliver refrigerant medium heat to a second fluid, wherein the first condenser and the second condenser are positioned downstream of the compressor and upstream of the expansion device in the refrigerant medium circuit, wherein the first condenser is located upstream of the second condenser in the refrigerant medium circuit; and a bypass arrangement for causing at least some refrigerant medium to selectively bypass the first condenser based upon a temperature condition indicative of heat demand on the second condenser.

11. The machine of claim 10 wherein the bypass arrangement includes a valve upstream of the first condenser, and a bypass path from the valve around the first condenser to a downstream side of the first condenser.

12. The machine of claim 11 wherein the valve is a proportional valve that is controllable to achieve simultaneous flow of a selectable portion of the refrigerant medium along the first flow path and a selectable portion of the refrigerant medium along the second flow path.

13. The machine of claim 11 wherein the bypass arrangement further includes a temperature sensor associated with the second condenser and operatively connected to effect control of the valve.

14. The machine of claim 13 wherein a controller is connected with the temperature sensor and is configured to responsively control the valve based upon the temperature condition.

15. The machine of claim 14 wherein the controller is configured to switch the valve to flow at least some refrigerant medium along the bypass path when the temperature sensor indicates a low temperature condition indicative of high heat demand on the second condenser.

16. The machine of claim 10 wherein the first fluid is incoming water, the first condenser arranged to deliver refrigerant medium heat to the incoming water and the incoming water is then delivered to a booster heater of the machine, and the second fluid is wash liquid within a wash tank of the machine, the second condenser arranged to deliver refrigerant medium heat to the wash liquid.

17. The machine of claim 16 further comprising:

a third condenser downstream of the second condenser, the third condenser arranged for delivering refrigerant medium heat to drying air of the machine;

a fourth condenser downstream of the third condenser, the fourth condenser arranged to deliver refrigerant medium heat to the incoming water before the incoming water reaches the first condenser;

a first waste heat recovery unit arranged to transfer heat from exhaust air of the machine to incoming water before the incoming water reaches the first condenser; and a second waste heat recovery unit arranged to transfer heat from exhaust air of the machine to refrigerant medium in the refrigerant medium circuit, the second waste heat recovery unit located along the refrigerant medium path downstream of the second condenser and upstream of a compressor.

18. A method of controlling refrigerant medium flow in a refrigerant medium circuit of a warewash machine that includes a chamber for receiving wares, the chamber having at least one wash zone, wherein the refrigerant medium circuit includes a compressor, an expansion device, a first condenser and a second condenser, wherein the first condenser and the second condenser are located downstream of the compressor and upstream of the expansion device in the refrigerant medium circuit, wherein the first condenser is located upstream of the second condenser in the refrigerant medium circuit, the method comprising:

flowing refrigerant medium through both the first condenser and the second condenser;

selectively bypassing at least some refrigerant medium flow around the first condenser based upon identification of a predefined refrigerant medium circuit condition downstream of the first condenser.

19. The method of claim 18 wherein the predefined refrigerant medium circuit condition is a heat demand condition of the second condenser, wherein heat demand of the second condenser is monitored by sensing a temperature condition of an environment of the second condenser.

20. The method of claim 19 wherein at least some refrigerant medium flow is selectively bypassed around the first condenser in response to identification of a low temperature condition of the environment of the second condenser.

* * * * *